United States Patent [19]

Knapp

[11] Patent Number: 4,780,998

[45] **Date of Patent: * Nov. 1, 1988**

[54] DECORATIVE WINDOW ASSEMBLY

[75] Inventor: Michael E. Knapp, Dayton, Ohio

[73] Assignee: American Woodwork Specialty Co., Inc., Dayton, Ohio

[ * ] Notice: The portion of the term of this patent subsequent to Sep. 12, 2004 has been disclaimed.

[21] Appl. No.: 92,444

[22] Filed: Sep. 3, 1987

Related U.S. Application Data

[63] Continuation of Ser. No. 008,636, Jan. 29, 1987, Pat. No. 4,693,043, which is a continuation of Ser. No. 824,855, Jan. 31, 1986, abandoned.

[51] Int. Cl.[4] ..... E06B 1/04; E04F 19/02

[52] U.S. Cl. ..... 52/211; 52/204; 52/397; 49/462

[58] Field of Search ..... 52/204, 208, 211, 213, 52/397, 398, 212, 214, 215, 217; 49/460, 462, 504

[56] References Cited

U.S. PATENT DOCUMENTS

| | | | |
|---|---|---|---|
| 4,459,789 | 7/1984 | Ford | 52/398 |
| 4,479,331 | 10/1984 | Bertolami et al. | 52/204 |
| 4,563,846 | 1/1986 | Webb | 52/208 |

FOREIGN PATENT DOCUMENTS

| | | | |
|---|---|---|---|
| 1115002 | 10/1961 | Fed. Rep. of Germany | 52/211 |
| 2203280 | 8/1973 | Fed. Rep. of Germany | 52/398 |
| 2357471 | 6/1974 | Fed. Rep. of Germany | 52/204 |
| 3239278 | 4/1984 | Fed. Rep. of Germany | 52/204 |
| 3234842 | 4/1984 | Fed. Rep. of Germany | 52/204 |

*Primary Examiner*—Michael Safavi

*Attorney, Agent, or Firm*—Jacox & Meckstroth

[57] ABSTRACT

A semi-circular dual window panel unit is supported by a correspondingly-shaped frame assembly including wood jamb members and removable wood sash members which extend completely around the window panel unit and confine an edge portion of the unit. A one-piece sheet of plastics material is vacuum-formed into a semi-circular cap member which is bonded to the frame. The cap member has an outwardly projecting mounting flange and an inwardly projecting protector flange which is spaced in front of the window panel unit by spacer strips. The protector flange has an inner peripheral lip bonded to the edge portion of the window panel unit by a resilient sealant material.

4 Claims, 1 Drawing Sheet

DECORATIVE WINDOW ASSEMBLY

RELATED APPLICATION

This application is a continuation of application Ser. No. 008,636, filed Jan. 29, 1987, now U.S. Pat. No. 4,693,043, which is a continuation of application Ser. No. 824,855, filed Jan. 31, 1986, abandoned.

BACKGROUND OF THE INVENTION

In the production of window units, such as double-hung and casement-type window assemblies, it is common to use wood strips to form the frame members and the sash members around each glass panel unit. The exterior portions of the wood members are sometimes covered with a vinyl layer or cladding to provide weather protection for the wood members and to eliminate the need for periodic painting or staining of the members. For example, U.S. Pat. No. 3,340,665 discloses the use of formed plastics sheeting material over the exterior portions of the wood frame members. U.S. Pat. No. 3,662,494 discloses wood frame members covered by an extruded cladding of plastics covering material. The extruded material has integral ribs and flanges which project into grooves within the wood for securing the cladding to the frame members.

Similarly, U.S. Pat. No. 4,479,331 discloses a double hung window assembly with extruded vinyl cladding strips secured to the wood frame members as well as to the wood sash members. The vinyl cladding may be extruded as separate strips which are cut and attached to the wood members or components, as shown in the above U.S. Pats. No. 3,662,494 and No. 4,479,331, or the cladding may be applied by passing each wood member or component through an extrusion head which extrudes a layer of vinyl directly onto the component.

SUMMARY OF THE INVENTION

The present invention is directed to an improved decorative window assembly which is ideally suited for use in the construction of a half-circle or semi-circular window assembly commonly used above a conventional rectangular window or entrance door. The window assembly of the invention incorporates a one-piece vacuum-formed sheet of plastics material which extends completely around the glass window unit and covers the exposed portions of the wood frame members. The sheet includes a lip portion which is sealed to the outer glass window panel to assure a completely weather-tight protective covering for the entire frame portions of the window assembly. In addition, the window assembly of the invention permits convenient removal of the glass window panel unit in the event the unit was accidentally cracked or broken.

In accordance with a preferred embodiment of the invention, a semi-circular window panel unit is supported by a surrounding semicircular frame assembly which includes wood jamb members and wood sash members which extend around the window panel unit with the sash members positioned on the jamb members by removable stop members. The outer or exposed portions of the jamb members are covered by a one-piece cap member which is vacuum-formed from a single sheet of plastics material. The cap member has an outwardly projecting peripheral mounting flange and an inwardly projecting flange spaced in front of the sash members by resilient sealing strips. The inner flange has a peripheral lip which projects rearwardly or inwardly to the glass panel unit and is sealed to the outer glass panel by a resilient sealant material. Thus the one-piece cap member forms a positive fluid-tight and weather protective covering for the entire frame which supports the glass window unit.

Other features and advantages of the invention will be apparent from the following description, the accompanying drawing and the appended claims.

DESCRIPTION OF THE PREFERRED EMBODIMENT

Figure 1:
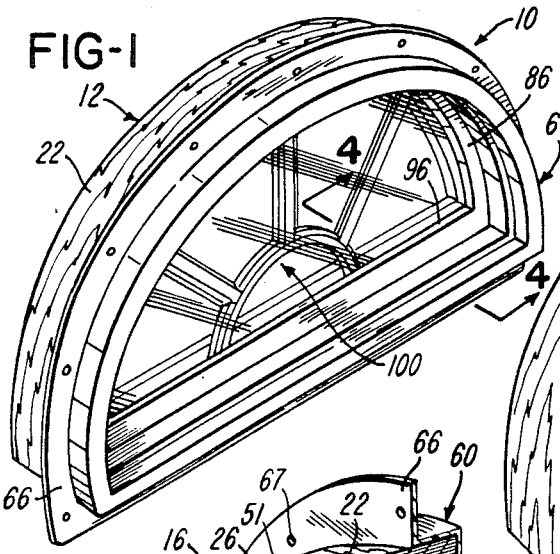
FIG. 1 is the perspective view of a semi-circular window assembly constructed in accordance with the invention.
Figure 3:
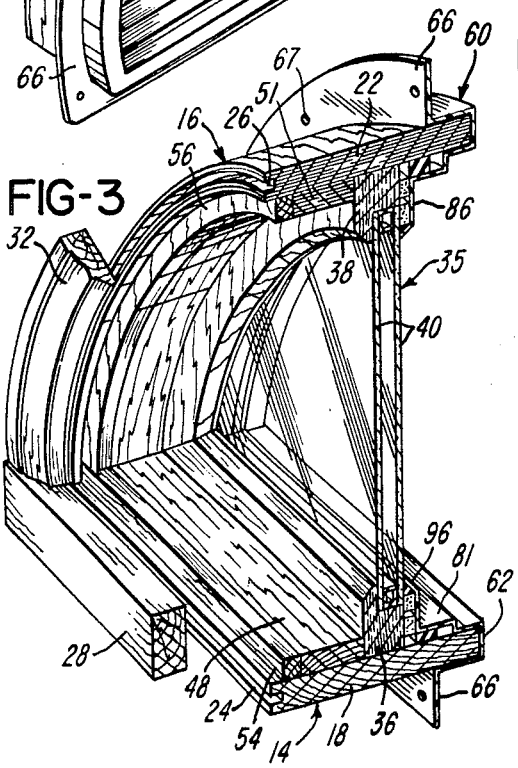
FIG. 3 is a fragmentary perspective section of the window assembly shown in FIG. 1.

FIG. 1 illustrates a decorative window assembly 10 which includes a wood frame 12 formed by a bottom sill or frame section 14 rigidly secured to an arcuate or semi-circular frame section 16. The bottom frame section 14 includes a flat jamb member 18, and the arcuate frame section 16 includes a corresponding arcuate or semi-circular jamb member 22 formed by laminated wood plies bonded together. The inner edges of the jamb members 18 and 22 have corresponding grooves 24 and 26 for receiving corresponding extension strips or pieces when it is desired to provide the frame 12 with a greater width. As illustrated, however, the grooves 24 and 26 are usually covered by corresponding trim members 28 and 32, as shown in FIG. 3.

A semi-circular insulated window panel unit 35 is supported within the frame 12 by a straight bottom wood sash member 36 which is rigidly connected to an arcuate or semi-circular wood sash member 38. The window panel unit 35 includes dual glazing or two semi-circular glass panels or sheets 40 having outer peripheral edge portions bonded by a rubber-like sealant material (not shown) to a spacer 42 which may be a plastic or aluminum extrusion or made by roll-forming an aluminum strip. The glass panel unit 35 seats within a peripheral recess 44 formed within the sash members 36 and 38, and the inner glass sheet or panel 40 is bonded by a layer 46 of silicone material to the sash members.

The sub-assembly of the window panel unit 35 and the sash members 36 and 38 is positioned within the corresponding jamb members 18 and 22 by a bottom stop member 48 and a laminated arcuate stop member 51 which are removably secured to the corresponding jamb members by a series of peripherally spaced screws 52. A straight bottom cap 54 and an arcuate upper cap 56 are secured to the corresponding jamb members 18 and 22 along the inner edges of the stop members 48 and 51.

A half-circle or semi-circular cap member 60 is vacuum-formed from a single sheet of plastics or vinyl material and includes a straight bottom portion 62 integrally connected to an arcuate upper portion 64, with each portion having a U-shaped cross sectional configuration. The sheet of vinyl also forms a peripherally extending mounting flange 66 which projects outwardly parallel to the window unit 35. Peripherally spaced holes 67 are formed within the flange 66 for securing the flange to the adjacent wall structure with suitable nails or fasteners. The portions 62 and 64 of the cap member 60 are cemented by a silicone adhesive to the corresponding outer portions of the jamb members 18 and 22 and include corresponding step portions 81 and 82 which form a peripherally extending shoulder 83.

The vinyl sheet forming the cap member 60 also forms a straight inner flange 84 and an arcuate inner flange 86, and the flanges 84 and 86 are spaced outwardly from the opposing sash members 36 and 38 and the outer peripheral edge portion of the window unit 35 by a set of resilient foam tapes or strips 92 adhesively bonded to the inner flanges 84 and 86. The portions 81 and 82 of the cap member 60 are spaced from the corresponding jamb members 18 and 22 by a substantially rigid vinyl strip 94 which is adhesively bonded to the portions 81 and 82.

Figure 2:
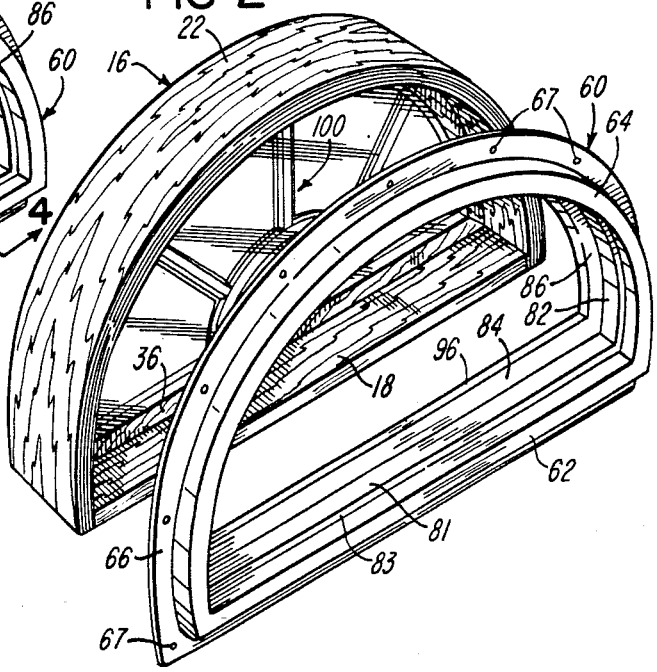
FIG. 2 is a partially exploded perspective view of the window assembly shown in FIG. 1.
Figure 4:
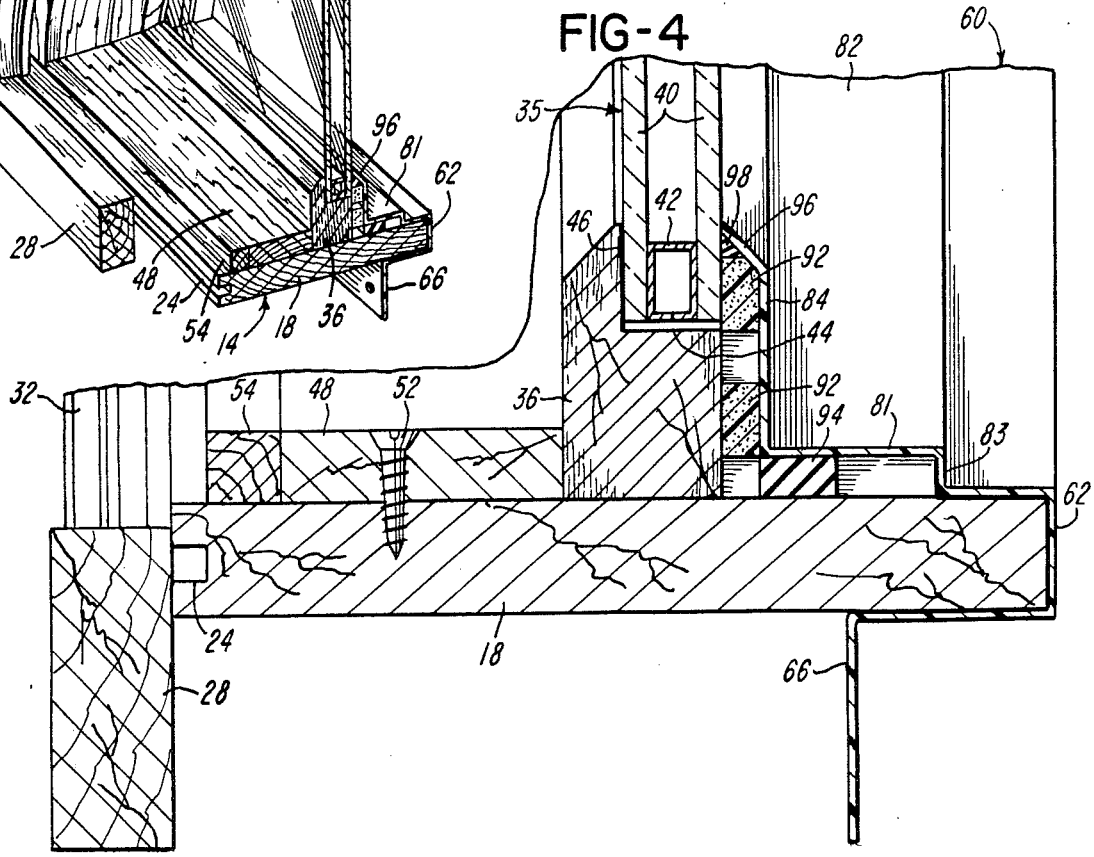
FIG. 4 is an enlarged fragmentary section of the window assembly taken generally along the line 4—4 of FIG. 1.

The vinyl sheet forming the cap member 60 terminates with an inner lip 96 which defines a semi-circular viewing opening for the window unit 35 and contacts the outer glass panel 40, as shown in FIG. 4. A resilient silicone sealant material 98 extends around the lip 96 adjacent the resilient strip 92 and bonds the lip 96 to the outer glass panel 40 to form a fluid-tight seal. As shown in FIGS. 1 and 2, a decorative removable grille 100 may be attached to the sash members 36 and 38 adjacent the inner surface of the inner glass panel 40.

It is apparent from the drawing and the above description that a window assembly 10 constructed in accordance with the present invention, provides desirable features and advantages. For example, the one-piece semi-circular cap member 60 forms a joint-free weather protector for the outer exposed portions of the window assembly 10 and forms a continuous weather-tight barrier from the outer glass panel 40 to the mounting flange 66. This continuous protector extends completely around the window unit 35 without any corner joints, and the strips 92 and 94 and the sealant material 98 provide for expansion and contraction of the cap member 60 relative to the wood frame 12 while the sealant material 98 maintains a permanent fluid-tight seal with the outer glass panel 40. In the event it became necessary to replace the window panel unit 35 due to an accidental crack or break, the stop members 48 and 51 are removed, and the window panel unit 35 is removed with the surrounding sash members 36 and 38 as a sub-assembly. After the window unit 35 is replaced within the sash members, the sub-assembly of the window unit and sash members are remounted on the jamb members after the sealant material 98 is replaced with a new bead of the sealant material.

While the specific decorative window assembly herein described constitutes a preferred embodiment of the invention, it is to be understood that the invention is not limited to the specific structure described, and that changes may be made therein without departing from the scope and spirit of the invention as defined in the appended claims.

The invention having thus been described, the following is claimed:

1. A window assembly comprising at least one flat window panel of light transmitting material, a wood frame extending completely around said window panel and including portions projecting forwardly generally perpendicular to said window panel, said frame further including wood sash members defining a recess receiving a peripheral edge portion of said window panel, a heat and pressure formed sheet of plastics material having a uniform thickness less than the thickness of said window panel and forming a one-piece cap member mounted on said frame, said cap member including integrally connected cover portions extending completely around said window panel and mounted on said forwardly projecting portions of said frame, said sheet of plastics material forming an integral outer flange portion projecting outwardly around said cover portions generally parallel to said window panel, said sheet of plastics material also forming integrally connected and coplanar inner flange portions projecting inwardly from said cover portions and extending completely around said window panel forwardly of said sash members and said window panel in generally parallel spaced relation to said window panel, said coplanar inner flange portions covering said sash members and said peripheral edge portion of said window panel within said recess, said sheet of plastics material further forming an integral lip portion extending completely around said peripheral edge portion of said window panel and projecting rearwardly from said inner flange portions to said window panel, and means forming a fluid-tight seal between said lip portion and said peripheral edge portion of said window panel, whereby said one-piece cap member extends continuously from said outer flange portion to said window panel completely around said window panel and forms a continuous protective barrier from said outer flange portion to said window panel.

2. A window assembly as defined in claim 1 and including means on said sash members for supporting said inner flange portions of said one-piece cap member.

3. A window assembly as defined in claim 1 wherein said lip portion of said one-piece cap member projects at an acute angle relative to said window panel, and said means forming a fluid-tight seal comprise a strip of resilient sealant material bonding said lip portion to said window panel.

4. A window assembly comprising at least one flat window panel of light transmitting material and having a non-rectangular configuration, a non-rectangular wood frame extending completely around said window panel and including portions projecting forwardly generally perpendicular to said window panel, said frame further including wood sash members defining a recess receiving a peripheral edge portion of said window panel, a heat and pressure formed sheet of plastics material having a uniform thickness less than the thickness of said window panel and forming a non-rectangular one-piece cap member mounted on said frame, said cap member including integrally connected cover portions extending completely around said window panel and mounted on said forwardly projecting portions of said frame, said sheet of plastics material forming an integral outer flange portion projecting outwardly around said cover portions generally parallel to said window panel, said sheet of plastics material also forming integrally connected and coplanar inner flange portions projecting inwardly from said cover portions and extending completely around said window panel forwardly of said sash members and said window panel in generally parallel spaced relation to said window panel, said coplanar inner flange portions covering said sash members and said peripheral edge portion of said window panel within said recess, said sheet of plastics material further forming an integral lip portion extending completely around said peripheral edge portion of said window panel and projecting rearwardly from said inner flange portions to said window panel, and means forming a fluid-tight seal between said lip portion and said peripheral edge portion of said window panel, whereby said one-piece cap member extends continuously from said outer flange portion to said window panel completely around said window panel and forms a continuous protective barrier from said outer flange portions to said window panel.

* * * * *